US006050532A

United States Patent [19]

Paul

[11] Patent Number: 6,050,532

[45] Date of Patent: Apr. 18, 2000

[54] COLLAPSIBLE SUPPORTS FOR PLANT CONTAINERS

[76] Inventor: Wayne L. Paul, 27 Old Post Rd., Longwood, Fla. 32779

[21] Appl. No.: 09/054,900

[22] Filed: Apr. 3, 1998

[51] Int. Cl.[7] ..... A47G 7/00; A01G 9/02

[52] U.S. Cl. ..... 248/214; 47/68

[58] Field of Search ..... 211/88.03, 41.5, 211/85.31, 90.03; 248/208, 236, 340, 215, 308, 214; 47/68, 40, 67

[56] References Cited

U.S. PATENT DOCUMENTS

| | | |
|---|---|---|
| 841,484 | 1/1907 | Campbell . |
| 933,142 | 9/1909 | Vogt . |
| 1,681,418 | 8/1928 | Livesay . |
| 1,832,801 | 11/1931 | Wright . |
| 2,529,267 | 11/1950 | Sloane . |
| 2,791,391 | 5/1957 | Uphoff . |
| 4,064,993 | 12/1977 | Getner . |
| 4,313,634 | 2/1982 | Williams . |
| 5,390,443 | 2/1995 | Emalfarb et al. . |
| 5,460,279 | 10/1995 | Emery et al. . |

*Primary Examiner*—Leslie A. Braun
*Assistant Examiner*—Jon A. Szumny
*Attorney, Agent, or Firm*—Allen, Dyer, Doppelt, Milbrath & Gilchrist, P.A.

[57] ABSTRACT

A collapsible support assembly for plant containers which can be easily broken down and, when fitted together, provide sound structural support for relatively heavy plant containers includes a vertical support rod defining a pair of spaced, vertically-extending arms, each arm having an upper end and a lower end with the vertical support member further including a horizontally-extending brace between the lower ends of the vertical arms. The assembly further includes a pair of rod end receptacles fixed to the vertical support member at spaced locations, each receptacle having a vertically-facing opening for receiving rod ends of an associated horizontal support member. The horizontal support member is formed of a shaped rod extending laterally from the vertical rods from first and second rod ends, each of which are downwardly extending and fitted within a corresponding one of the rod end receptacles.

24 Claims, 6 Drawing Sheets

COLLAPSIBLE SUPPORTS FOR PLANT CONTAINERS

BACKGROUND OF THE INVENTION

1. Field of the Invention

The present invention relates in general to supports for plant containers, and specifically to such supports which are both collapsible and capable of being suspended from a deck railing or similar architectural feature.

2. Description of the Prior Art

Hanging supports for plant containers are well known in the art for supporting a flower pot, planter box or similar plant container from a deck railing, fence or similar structure. Arrangements of this type have been sold in the past by HMN Corporation of Toledo, Ohio under the trademark HANG OVERS. Similar structures are also disclosed in U.S. Pat. No. 5,390,443 to Emalfarb et al and related U.S. Design Pat. Nos. 339,942 and 338,122. The railing hangers disclosed in the Emalfarb et al patents are formed of bent rod material which is welded at appropriate points to form the support construction.

The use of bent rod or wire material for collapsible supports is well known in the prior art. Examples of such arrangements are disclosed in the following U.S. Pat. No. 841,484 to Campbell; U.S. Pat. No. 933,142 to Vogt; U.S. Pat. No. 1,681,418 to Livesay; U.S. Pat. No. 2,529,267 to Sloan; U.S. Pat. No. 2,791,391 to Uphoff; U.S. Pat. No. 4,313,634 to Williams; and U.S. Pat. No. 5,460,279 to Emery et al. Other prior art of interest includes U.S. Pat. No. 1,832,801 to Wright and U.S. Pat. No. 4,064,993 to Getner.

A shortcoming of constructions like that disclosed in the Emalfarb et al patents is the inability to collapse the constructions into constituent parts so as to lie in a relatively flat plane for storage and shipping. While some of the above-identified prior art references disclose collapsible structures, the fabrication techniques do not lend themselves to providing a sufficiently strong structure so as to support a relatively heavy plant container, while maintaining the desired collapsible features.

SUMMARY OF THE INVENTION

The present invention is directed to a collapsible support assembly for plant containers which can be easily broken down and, when fitted together, provides sound structural support for relatively heavy plant containers such as the flower pots and plant trays which are in commercial use today.

A preferred embodiment of the support assembly includes a vertical support rod defining a pair of spaced, vertically-extending arms, each arm having an upper end and a lower end with the vertical support member further including a horizontally-extending brace between the lower ends of the vertical arms. The assembly further includes a pair of rod end receptacles fixed to the vertical support member at spaced locations, each receptacle having a vertically-facing opening for receiving rod ends of an associated horizontal support member. The horizontal support member is formed of a shaped rod means extending laterally from the vertical rods from first and second rod ends each of which are downwardly extending and fitted within a corresponding one of the rod end receptacles. Means are also included with the vertically-extending rods for facilitating attachment of the plant support assembly to a railing or similar structure.

It will of course be appreciated by those skilled in the art that the use of the terms "vertical," "vertically-extending," "horizontally-extending," "vertically-facing" and "horizontal" in the above description of the preferred embodiment refers to the vertical and horizontal directions in relation to a support assembly which is in fact mounted for purposes of supporting a plant container in the intended manner.

Further in accordance with the preferred embodiment, both the vertical arms and the horizontally-extending brace are formed from a unitary length of bent rod which suitably includes at least four bends between the vertical arms and the horizontally-extending brace in order that the brace forms a standoff extending in a lateral direction with respect to the vertical arms, with each rod end receptacle positioned along the corresponding arm adjacent the horizontally-extending brace. The standoff permits the support assembly to be positioned substantially vertically when properly positioned on a deck railing or similar construction.

The horizontal support member of the preferred embodiment suitably comprises a unitary rod forming either a generally U-shaped configuration or a generally circular configuration in order to define a horizontal platform for supporting a flower pot or plant tray.

Means are also provided for providing a protective rim for plant containers, which rim is also collapsible with the support assembly. In one arrangement, the protective rim is formed along the unitary rod forming the horizontal support member; in another embodiment, the protective rim is removably attached to the vertically-extending rods of the vertical support member intermediate the upper and lower ends thereof.

An important feature of the collapsible support assemblies of the present invention is the facile construction of the rod end receptacles which impart significant strength characteristics to the entire assembly, while permitting the assembly to be readily collapsed for storage or shipment and then later easily fitted together for use. The rod end receptacles comprise a length of tubing having first and second generally parallel bores with the lower end of the corresponding vertical arm extending through the first bore and a corresponding rod end of the unitary horizontal rod extending through the second bore. The rod end receptacles can be easily formed of a unitary tubular member with a central crimp which forms the first and second bores. Similar rod end receptacles are useful for the protective rim, when attached to the vertically-extending rods intermediate the ends thereof.

The means for facilitating attachment of the support assembly to a railing or similar structure includes either of a unitary hook formed at the upper end of each vertically-extending rod or a bracket which may be attached to the upper ends of the vertically-extending rods in an adjustable manner and fitted about a deck railing or similar construction.

THE DRAWING

DETAILED DESCRIPTION

A first embodiment of a collapsible support assembly for plant containers which can be easily broken down and fitted together will now be described with reference to FIGS. 1–6.

Figure 1:
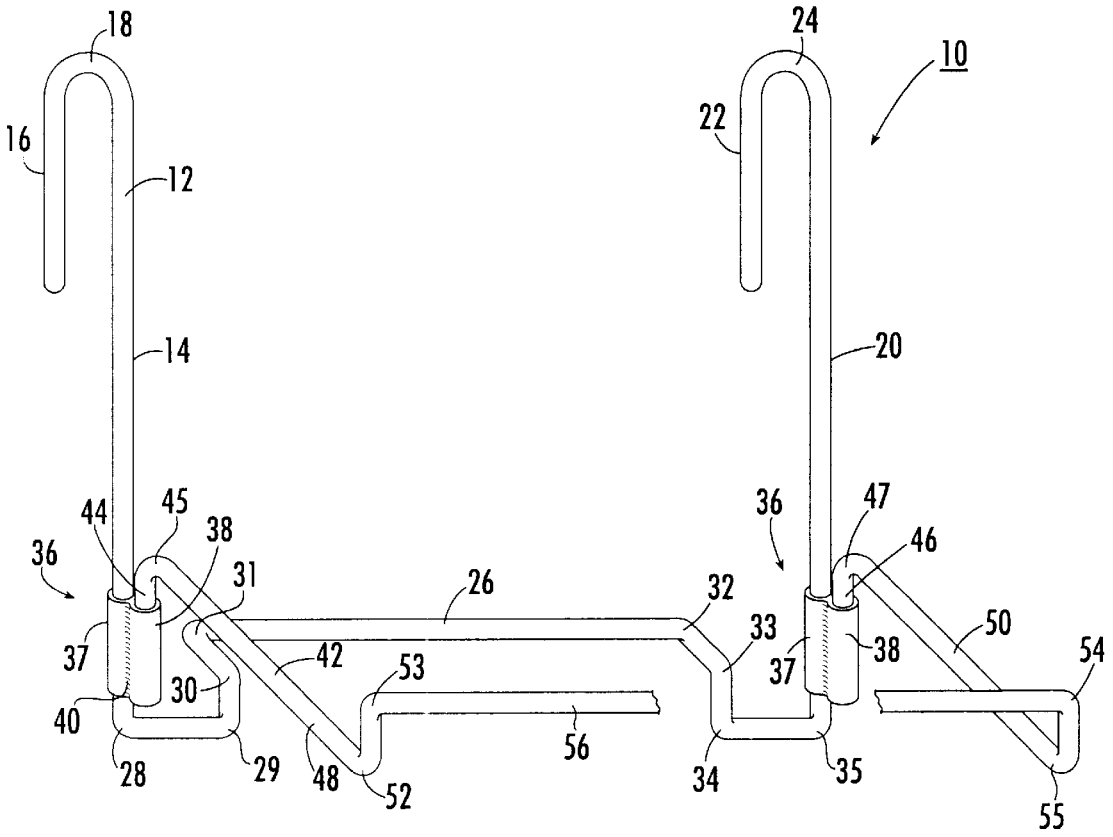
FIG. 1 is a perspective view, partially cut away, of a first embodiment of a collapsible support assembly for plant containers in accordance with the present invention.

The support assembly, referred to generally by the reference 10, is substantially formed from two continuous lengths of bent rod, which rods are identified by reference numerals 12 and 56. The first rod 12 forms a unitary vertical support rod member, having a pair of spaced, generally parallel and vertically-extending arms 14, 20 joined at the lower extremities thereof by a horizontal brace 26 with bends 28–35, inclusive, along the rod member 12 between the vertical arms 14, 20 and the brace 26. As is depicted in FIG. 1, by a short length of the rod 12, so as to form the horizontally-extending brace 26 into a standoff which extends in a lateral direction with respect to the vertical arms 14, 20, and parallel to a horizontal support member defined by the second rod 56, as described in greater detail below.

The support assembly 10 further includes unitary support hooks 16, 22 defined by bends 18, 24 at the upper ends of the vertically-extending arms 14, 20.

Figure 2:
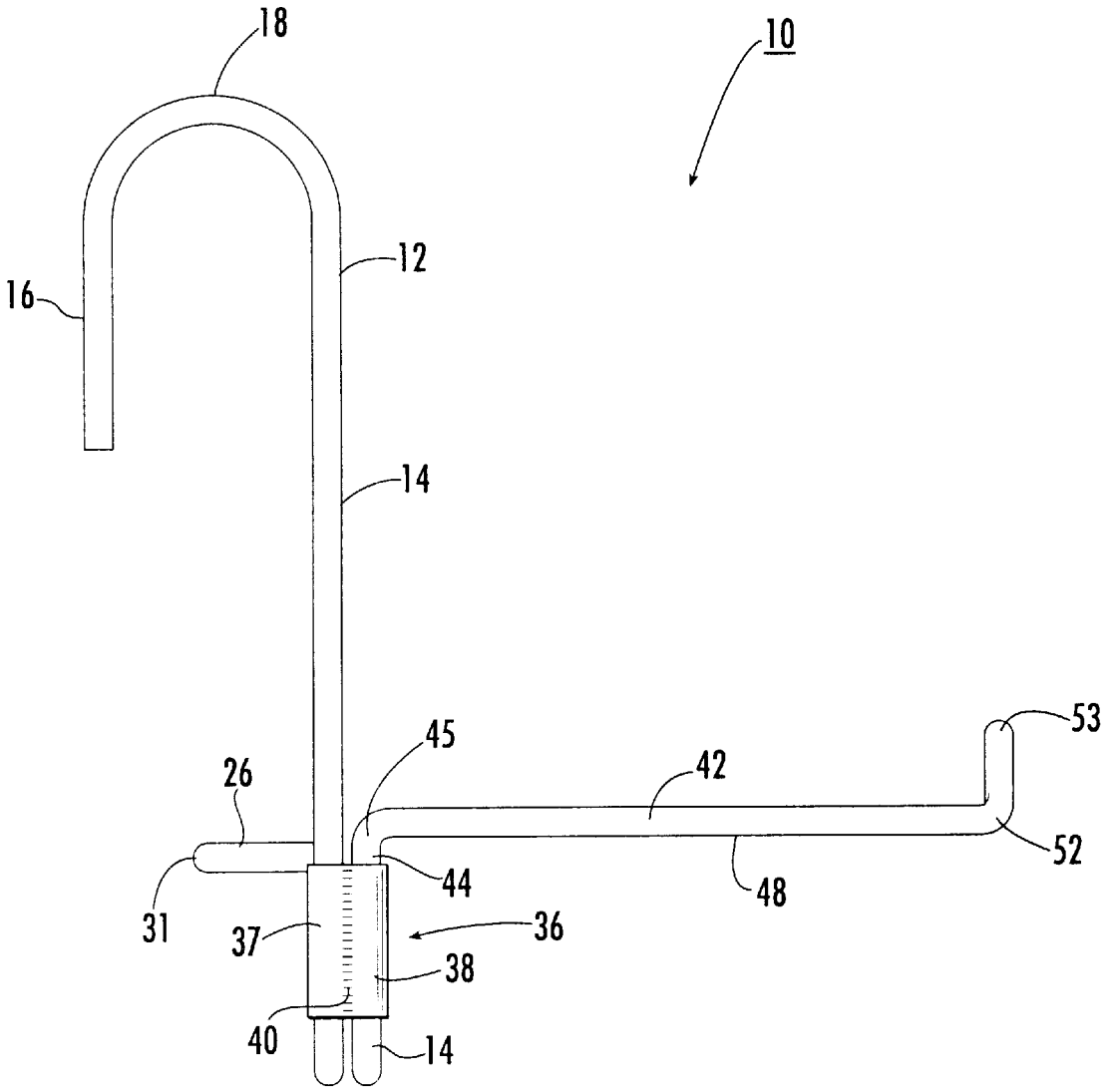
FIG. 2 is a side view of the support assembly of FIG. 1.
Figure 3:
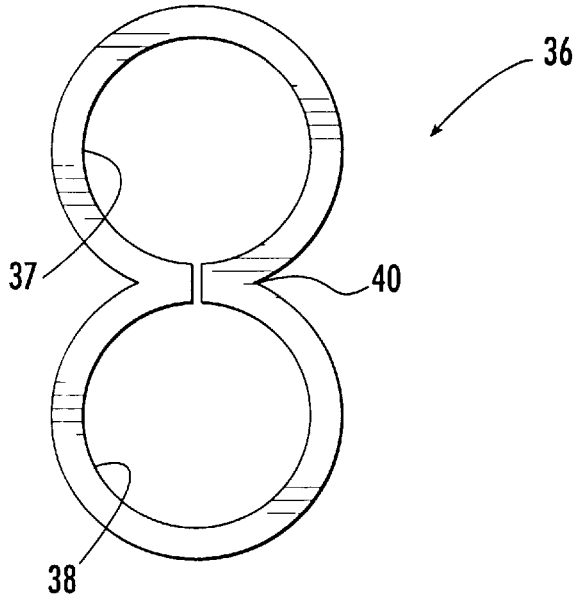
FIGS. 3 and 4 are top plan and side views, respectively, of the rod end receptacle feature of the support assembly depicted in FIGS. 1 and 2.
Figure 4:
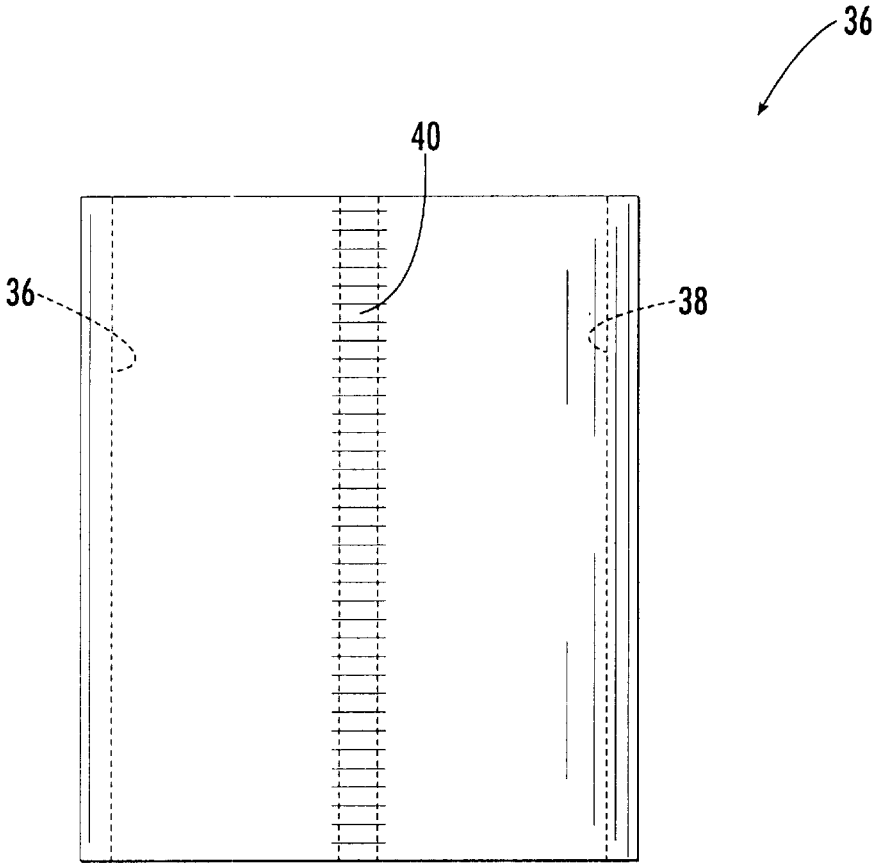
Figure 6:
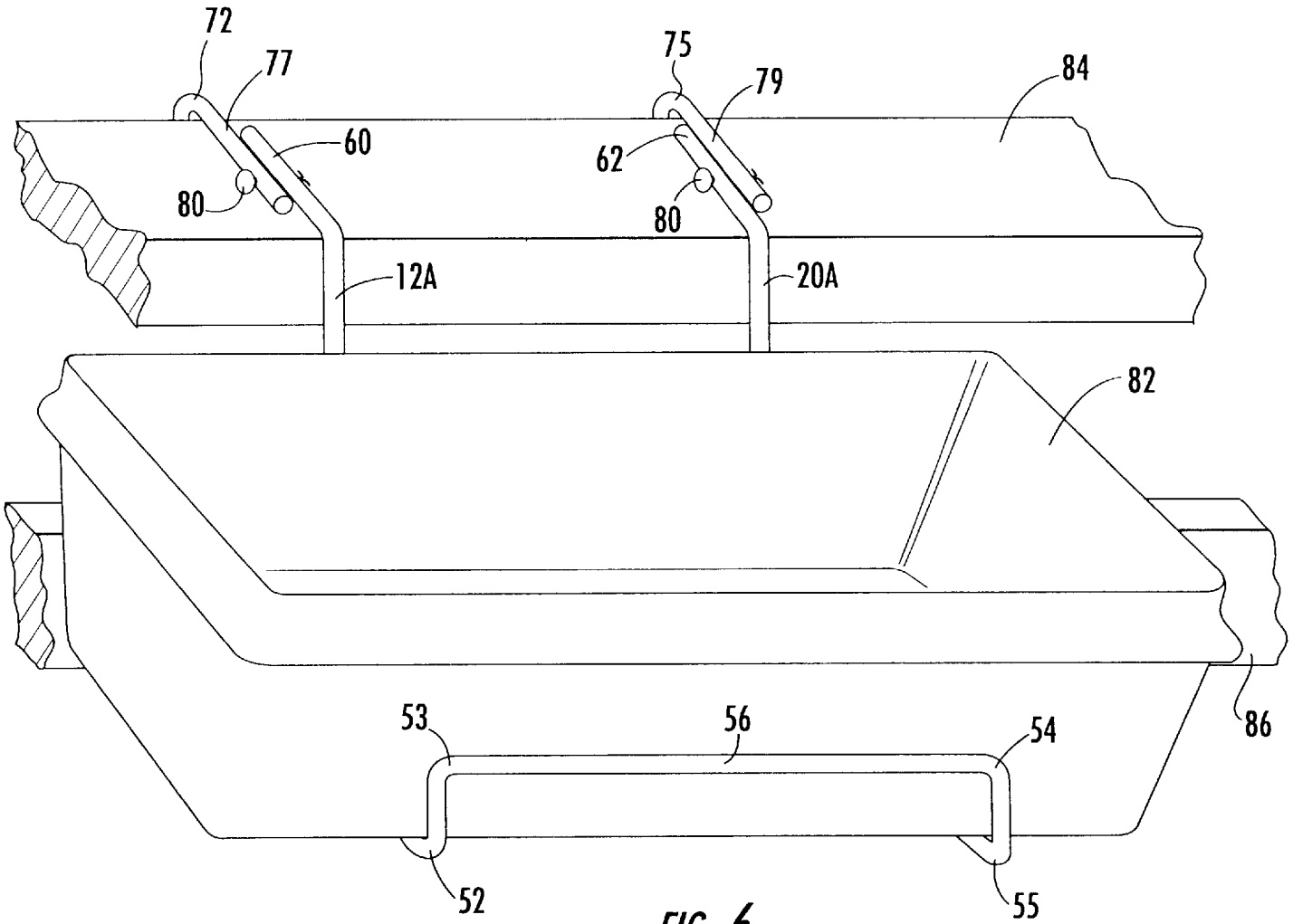
FIG. 6 is a perspective view illustrating the use of a support assembly in accordance with the present invention with a plant tray.

In order to permit the assembly 10 to be easily collapsed and then reassembled while achieving substantial strength for purposes of holding relatively heavy plant containers, the assembly 10 is provided with rod end receptacles 36 for permitting the removable attachment of the second, horizontal rod 56. The rod end receptacles 36, which are described in detail with reference to FIGS. 3 and 4, are formed from a unitary length of tubular material which is provided with a central crimp 40 which defines a pair of generally cylindrical and parallel bores 37, 38. As shown in FIG. 1 and 2, a pair of the rod end receptacles 36 are fitted onto the vertical arms 14, 20 of the first rod member 12 adjacent the lower ends thereof near the horizontal brace 26, with the arms 14, 20 extending through respective first bores 37. The unitary horizontal support rod 56 has first and second vertical rod ends 44, 46 which are fitted into a corresponding one of the second bores 38 of the first and second rod end receptacles 36 and with first and second bends 45, 47 along the horizontal support rod 56 adjacent the first and second rod ends so as to form an enclosing horizontal support structure extending laterally from the vertical arms 14, 20 in a direction opposite to the direction of extension of the horizontal brace 26. The second rod 56 includes laterally-extending portions 48, 50 and additional bends 52–55 which permit the horizontal rod member to define a protective rim for a plant container, as illustrated in FIG. 6.

Figure 5:
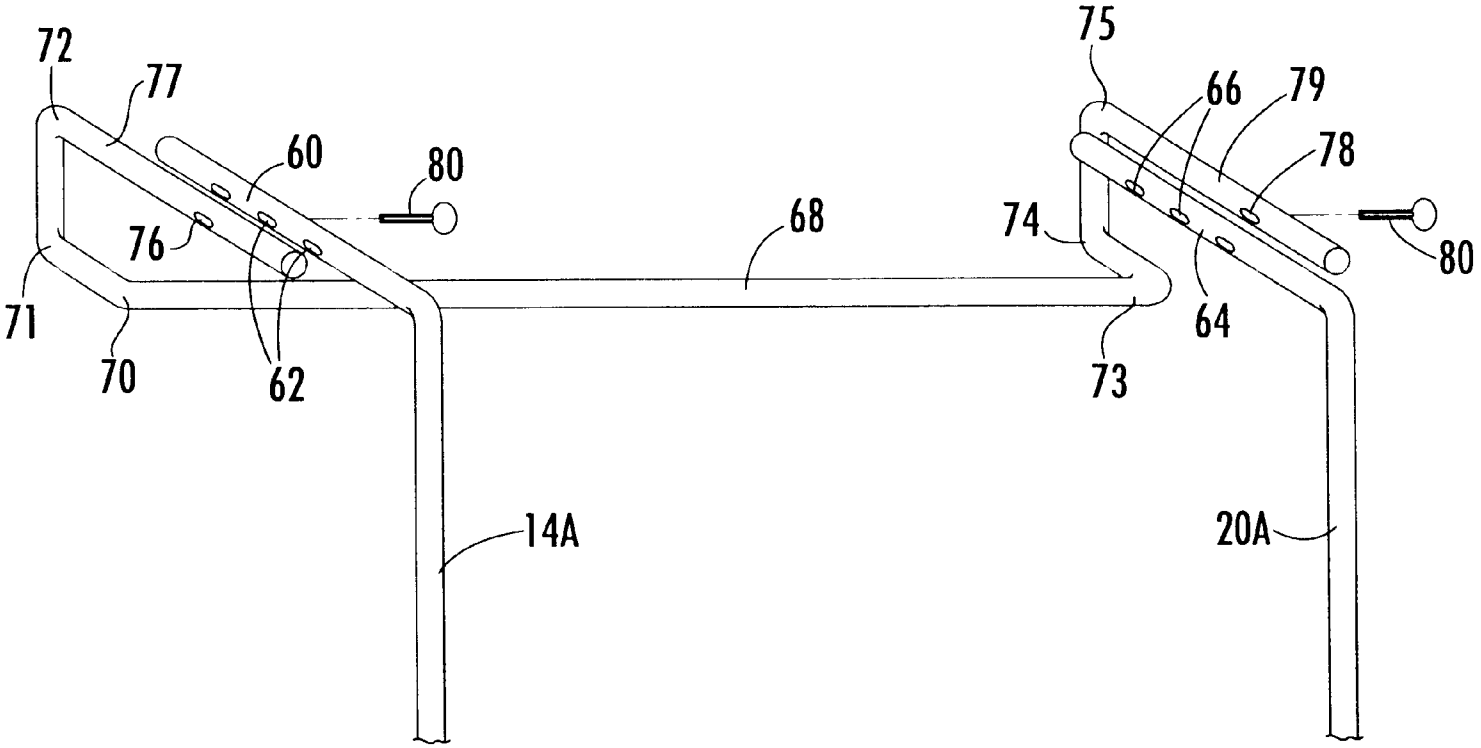
FIG. 5 is a perspective view of an alternate construction for facilitating attachment of the support assembly to a railing or similar structure.

An alternate construction for facilitating attachment to a deck railing or similar structure is shown in FIG. 5, where the vertical arms 14A, 20A are provided with horizontal extensions 60, 64 at the respective upper ends and with holes 62, 66 along their respective lengths. A bracket rod 68 includes multiple bends 70–75 along its length so as to provide the generally U-shaped configuration shown in FIG. 5. Holes 76, 78 in the bracket 68 permit a cotter key 80 to be adjustably inserted at appropriate points along the respective lengths of the bracket 68 and the lateral extensions 62, 64 in order to facilitate attachment to a deck railing.

Figure 7:
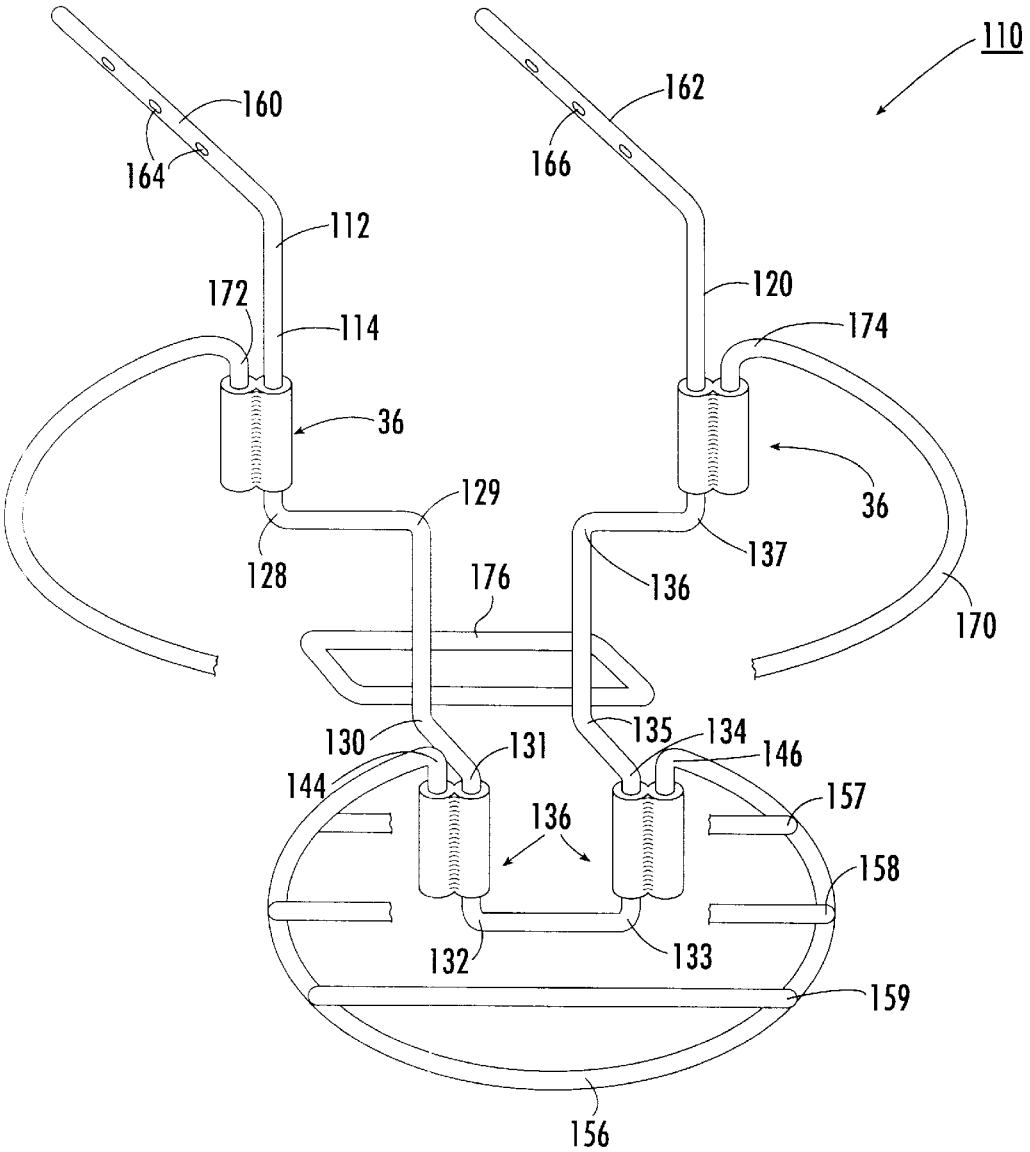
FIG. 7 is a perspective view, partially cut away, of a second embodiment of support assemblies in accordance with the present invention, the second embodiment being specifically designed for traditional flower pots having a circular cross section.

A second embodiment of a support assembly in accordance with the present invention is depicted in FIG. 7 and referred to generally by the reference numeral 110. The support assembly 110, in the same manner as the embodiment of FIGS. 1–6, is formed substantially from a first vertically-extending bent rod 112 and a second, horizontally-extending bent rod 156. The vertical rod 112 defines vertical arms 114, 120 and ten bends 128–137 along the length of the first rod 112 between the vertical arms 114, 120, with offsets between each adjacent bend so as to define desirable features in this particular embodiment. For example, bends 128, 129 and 136, 137 with related offsets therebetween reduce the dimension between the vertical arms 114, 120 so as to facilitate the use of an encircling horizontal rod 156, as illustrated in FIG. 7. Likewise, bends 130–135 form a lateral extension so as to hold the horizontal rod 156 away from the plane defined by the vertical arms 114, 120; and bends 131–134 define a vertical extension which facilitates installation of rod end receptacles 36 for attachment of the horizontal rod 156 at respective first and second vertically-extending rod ends 144–146. If desired, a protective rim along horizontal rod 156 like that depicted in the embodiment of FIG. 1 could be provided; however, because of the nature of circular flower pots, it is desirable in this instance to provide a generally circular protective rim 170 fitted to respective rod end receptacles 36 at an upper portion of the vertical arms 114, 120 at respective rim member ends 172, 174.

Horizontal rods welded to the plane of circular horizontal rod 156 provides a bottom support for plant containers. A generally rectangular rod 176 can be suitably affixed to the rear of the assembly 110 to provide a standoff.

It will be appreciated by those skilled in the art that the particular rod material used is not critical to the invention, so long as sufficient structural integrity is imparted to the assembly. However, without limitation, it has been found that a steel rod about 5–9 millimeters in diameter and which is vinyl dipped or powder coated is suitable in this specific application.

This concludes the description of the preferred embodiments. A reading by those skilled in the art will bring to mind various changes without departing from the spirit and scope of the invention. It is intended, however, that the invention only be limited by the following appended claims.

What is claimed is:

1. A collapsible support assembly for plant containers which can be easily broken down and fitted together, the assembly comprising:

a vertical support member including a pair of spaced, vertically-extending rods, each rod having an upper end and a lower end, the vertical support member further including a horizontally-extending brace between the lower ends of the vertically-extending rods;

a pair of rod end receptacles fixed to the vertical support member at spaced locations, each receptacle having an upwardly vertically-facing opening for receiving rod ends of an associated horizontal support member;

a horizontal support member formed of a shaped rod means extending laterally from the vertical rods from first and second rod ends each of which are downwardly extending and removably fitted within a corresponding one of the rod end receptacles; and means attached at the upper ends of the vertically-extending rods for facilitating attachment of the support assembly to a railing or similar structure.

2. The plant support assembly recited in claim 1 wherein the vertically-extending rods and the horizontally-extending brace are formed from a unitary length of bent rod.

3. The plant support assembly recited in claim 1 further comprising standoff means adjacent the lower ends of the vertical rods and extending in a lateral direction opposite to the direction of the horizontal support member.

4. The plant support assembly recited in claim 3 wherein the standoff means comprises shaped bends in the horizontally-extending brace.

5. The plant support assembly recited in claim 3 wherein the standoff means comprises a bent rod forming a closed loop and attached adjacent the lower ends of the vertically-extending rods.

6. The plant support assembly recited in claim 1 wherein the horizontal support member comprises a unitary rod forming a generally U-shaped configuration with opposing, generally parallel sides and a front portion between the two sides.

7. The plant support assembly recited in claim 6 wherein the front portion of the unitary rod extends generally parallel with the horizontally-extending brace of the vertical support member.

8. The plant support assembly recited in claim 6 wherein the sides of the unitary rod includes upward bends at forward extremities thereof, so that the front portion forms a protective rim for plant containers resting on the horizontal support member.

9. The plant support assembly recited in claim 1 wherein the horizontal support member comprises a unitary rod forming a generally circular configuration.

10. The plant support assembly recited in claim 9 wherein each vertically-extending rod of the vertical support member is defined by an outward bend, an outwardly-extending horizontal portion and a downward bend with the horizontal brace extending between extremities of the downward bend.

11. The plant support assembly recited in claim 10 further comprising:

a second pair of rod end receptacles, each receptacle of the second pair positioned on a corresponding one of the vertically-extending rods intermediate between the upper and lower ends thereof; and a protective rim member formed of a second unitary rod extending laterally from the vertical rods from first and second unitary rod ends each of which is fitted within a corresponding one of the second pair of rod end receptacles.

12. The plant support assembly recited in claim 1 wherein the rod end receptacles comprise a length of tubing having first and second generally parallel bores, with one of the lower ends of a corresponding vertical rod extending through the first bore and a corresponding rod end of the unitary horizontal rod extending through the second bore.

13. The plant support assembly recited in claim 12 wherein each rod end receptacle comprises a unitary tubular member with a crimp between the first and second bores.

14. The plant support assembly recited in claim 1 wherein the means for facilitating attachment comprises a bend along the upper end of each vertically extending rod.

15. The plant support assembly recited in claim 1 wherein the means for facilitating attachment comprises:

a hook member adapted to fit about a railing; and means for adjustably attaching the hook member to the upper ends of the vertically-extending rods.

16. The plant support assembly recited in claim 15 wherein the hook member comprises a unitary length of rod with bends along its length to permit attachment to a railing.

17. A collapsible support for plant containers which is easily assembled and disassembled and is substantially formed from two continuous lengths of bent rod, comprising:

a unitary vertical support rod member having a pair of spaced, generally parallel and vertically-extending arms joined at lower extremities thereof by a horizontal brace with bends along the rod member between the vertically-extending arms and the brace;

a pair of rod end receptacles, each receptacle fixed to a vertically extending arm adjacent the lower extremity thereof and having an upwardly vertically-facing opening for receiving a rod end of an associated horizontal support rod member;

a unitary horizontal support rod member having first and second vertically-extending rod ends each fitted into a corresponding one of the first and second rod end receptacles and with first and second bends along the horizontal support rod adjacent the first and second rod ends so as to form an enclosing horizontal support structure extending laterally from the vertically-extending arms of the vertical support rod member; and means attached at the upper ends of the vertically extending arms of the vertical support rod member for facilitating attachment of the plant support assembly to a railing or similar structure.

18. The plant support recited in claim 17 further comprising a pair of spaced bends along each vertically extending arm adjacent the lower extremity thereof so that the horizontal brace is laterally offset with respect to an imaginary plane including both vertically extending arms.

19. The plant support recited in claim 18 wherein the horizontal brace offset is in a lateral direction toward the horizontal support rod member.

20. The plant support recited in claim 19 wherein the horizontal rod member forms a generally circular configuration.

21. The plant support recited in claim 20 comprising:

a second pair of rod end receptacles each positioned on a corresponding one of the vertical rods intermediate between the upper and lower ends; and a second unitary horizontal support rod member extending laterally from the vertical rods from first and second rod ends thereof, each of which is fitted into a corresponding one of the second pair of rod end receptacles.

22. The plant support recited in claim 21 further comprising a pair of bends along each vertically-extending arm of the vertical support rod member intermediate between the two rod end receptacles along each vertically extending arm, both bends lying in the plane of the vertical support arms so as to reduce the dimension between the vertical support arms between the rod end receptacles associated with each arm.

23. The plant support recited in claim 17 further comprising at least four bends along the vertical support rod member between the vertically-extending arms with the horizontal brace forming a standoff extending in a lateral direction with respect to the arms, and wherein each rod end receptacle is positioned along the corresponding arm adjacent the horizontal brace.

24. The plant support recited in claim 23 wherein the vertical support rod member comprises eight bends along the horizontal brace.

* * * * *